US006843586B1

(12) United States Patent
Allaire

(10) Patent No.: US 6,843,586 B1
(45) Date of Patent: Jan. 18, 2005

(54) LIGHTING ASSEMBLY

(76) Inventor: Thomas C. Allaire, 26 Pasé Mediano, Carmel Valley, CA (US) 93924

( * ) Notice: Subject to any disclaimer, the term of this patent is extended or adjusted under 35 U.S.C. 154(b) by 174 days.

(21) Appl. No.: 10/359,506

(22) Filed: Feb. 6, 2003

Related U.S. Application Data

(60) Provisional application No. 60/354,618, filed on Feb. 6, 2002.

(51) Int. Cl.[7] ..... F21V 7/00

(52) U.S. Cl. ..... 362/298; 362/147; 362/302; 362/404

(58) Field of Search ..... 362/145–150, 362/243, 247, 296–302, 304, 305, 310, 347–350, 364, 404–408

(56) References Cited

U.S. PATENT DOCUMENTS 1,300,202 A * 4/1919 Stubblefield ..... 362/303
3,749,906 A * 7/1973 Thiry ..... 362/301
4,450,513 A * 5/1984 Guggemos ..... 362/299
5,278,731 A * 1/1994 Davenport et al. ..... 362/551
5,988,829 A * 11/1999 Holder ..... 362/217
6,634,759 B1 * 10/2003 Li ..... 359/853

* cited by examiner

*Primary Examiner*—Thomas M. Sember
*Assistant Examiner*—Hargobind S. Sawhney
(74) *Attorney, Agent, or Firm*—IP Strategies

(57) ABSTRACT

A lighting assembly includes a light socket, a first reflector base, and a second reflector base. The light socket is at least partially disposed in a housing, and is used to secure and provide electrical power to a light source. The first reflector base has an aperture through which the light socket is accessible, and a reflective surface generally facing away from the light socket, and therefore the light source. The second reflector base is connected to the first reflector base, the light source housing, or both, and has a reflective surface generally facing the light source and the reflective surface of the first reflector base. Light provided by the light source is reflected from the second reflective surface and then the first reflective surface, providing indirect lighting for an observer.

20 Claims, 7 Drawing Sheets

LIGHTING ASSEMBLY

CROSS-REFERENCE TO RELATED APPLICATION

This is related to, and claims a benefit of priority from, U.S. Provisional Patent Application Ser. No. 60/354,618, which was filed on Feb. 6, 2002.

FIELD OF THE INVENTION

The present invention relates to lights, light fixtures, and other lighting apparatus for residential and commercial use.

BACKGROUND OF THE INVENTION

In the field of residential and commercial lighting, a variety of applications generate light from point sources. Whether a lighting application utilizes charged gas particles, such as a neon tube, or a current resisting filament, such as an ordinary household light bulb, the intensity of the light generated at the point source can be significant. In many instances, the light intensity is great enough to cause discomfort or harm to any person viewing the light at its point source. As a result, numerous constructions have been utilized to shield viewers from the intense light emanating from the point where the light is generated. At the same time, these designs have been intended to facilitate the diffusion of as much of the generated light as possible in order to maintain an efficient lighting application. The result is that these lighting applications balance the requirement to shield viewers from the intense light at its point source with the requirement to use as much of the generated light as possible, but in a diffused form.

This balance of requirements has been accomplished in various ways. For example, ordinary household light bulbs are often frosted in order to reduce the intensity of light at the point source while diffusing as much of the generated light as possible. In addition, frosted and textured globes serve a similar purpose. In related applications, light sources are often shaded, which primarily serves to block the intense light at its point source from the viewer while at the same time redirecting useable light to reflective surfaces such as walls and ceilings. Another solution utilized to block light from the viewer is a recessed lighting application, which removes the light source from the common view, in order to reduce the chance that a viewer will encounter intense light at the point source. While all of these conventional arrangements are intended to provide diffused light with minimal light loss, it remains that a significant amount of light must be blocked in order to reduce the chance that a viewer will encounter intense light at its point source.

In providing a solution to these competing requirements, torchiere-type lights have been utilized to provide light that is nearly entirely reflected off nearby walls and ceilings. The light source is positioned in an opaque bowl at the top end of a pedestal so that a viewer has virtually no opportunity of encountering the intense light at its point source. At the same time, the light source is positioned within the bowl so that much of the generated light is directly projected toward the nearby walls and ceilings. The remaining generated light is reflected from the interior of the bowl toward the same nearby walls and ceilings, thereby minimizing the amount of light that is lost. Thus, the torchiere uses a single, large, high-efficiency light source, an improvement over the small, multiple bulbs used by conventional lamps. The torchiere also provides a more uniform light distribution, and allows for variable beam control. However, there are disadvantages to torchiere-type lights as well. In particular, the pedestal usually must be tall, which makes the lamp inherently unstable; the intensity and heat produced by the luminaire is usually greater than that of an ordinary household light bulb, thereby posing a greater fire risk; and the wiring used by a torchiere-type light is similar to that used in ordinary table and floor lamps, which can contribute to common household accidents.

Thus, while existing lighting applications have increased the amount of useable light and improved shielding, inherent disadvantages continue to exist. The noted deficiencies should be overcome in order to maximize the amount of useable light, maintain shielding, and otherwise improve existing lighting applications. The resulting lighting effect should also be more pleasing and efficient than that provided by a direct lighting source.

SUMMARY OF THE INVENTION

The present invention provides many of the advantages of the torchiere-type light while at the same time improving upon the inherent disadvantages of that lighting application. In particular, the light source for the present invention is contained in a housing that is recessed in a ceiling or other structure and directed toward a pendant reflector similar to the reflective bowl provided behind the lighting element in torchiere-type lights. This provides a construction for reflecting and diffusing light. Page: 3 The resulting construction results in a reduction in the amount of glare present at the light source, allows for the utilization of glass and heat-sensitive materials that cannot otherwise be used in ceiling lighting fixtures, as well as the use of the latest lamp technologies, such as fluorescent, HID, LED, and halogen light sources. In contrast to conventional pendant fixtures, the present invention provides a recessed light source with a non-electrical suspension and reflector.

Preferred embodiments of the present invention use a single, efficient focused beam lamp, rather than multiple small flood lamps. The design makes use of a hidden recessed housing for the larger lamp, as well as novel recessed housings, and allows for single lamp replacement maintenance. The passive reflector of the present invention, which does away with visible lamp and electrical hardware, provides a more pleasing, shallow profile, allows use of heat sensitive materials, with reduced fire hazard, and enables the use of less opaque, more transparent materials. Particular embodiments include a slender suspension, provided by a continuous loop to provide simpler height (drop), slope, and leveling adjustments. The suspension can be effectuated by variable lacing configurations, or fixed length chain or spoke suspension materials.

Additionally, the present invention incorporates specific ceiling structures, not present in conventional lights, such as pendant fixtures, that are designed to enhance the diffusion of the generated light. Also, because the light source is not incorporated as part of the pendant reflector, the attendant fixture and lighting elements do not obstruct movement within a room, as conventional floor lamps can. Further, the absence of such elements allows more flexibility in the choice of materials for the pendant reflector itself, due to the reduced proximity of the light source to the reflector.

An embodiment of the present invention includes a light source contained within a housing recessed within a ceiling. Illumination from the light shines downward in a substantially vertical orientation and reflects off a concave reflector suspended from the ceiling and positioned directly in the path of the light. The result is that the generated light is both shielded by the pendant reflector and diffused by being reflected onto the walls and ceiling. The suspension apparatus for the pendant reflector includes a continuous loop of flexible cord or ire that is threaded between the ceiling and the reflector. This allows the orientation of the pendant reflector to be adjusted easily without special tools. In addition, the present invention can be outfitted with a reflector dome or reflector cove positioned around the light source and opposite the reflective surface of the pendant reflector. These aspects serve to redirect the diffused light reflected by the pendant reflector while shielding a viewer from the intense light present at its point source.

According to one aspect of the present invention, a lighting assembly includes a light socket, a first reflector base, and a second reflector base. The light socket is at least partially disposed in a housing. The first reflector base has an aperture through which the light socket is accessible, and a reflective surface generally facing away from the light socket. The second reflector base is connected to the first reflector base, the light source housing, or both, and has a reflective surface generally facing the light source and the reflective surface of the first reflector base.

The first reflection base can have a flat reflective surface adjacent the aperture, and a curved reflective surface at the periphery of the first reflection base, wherein the curved reflective surface curves generally toward the second reflector base. Alternatively, the reflective surface of the first reflector base can be concave altogether, wherein the concavity is directed generally toward the second reflector base. Likewise, the reflective surface of the second reflector base can be concave, wherein the concavity is directed generally toward the first reflector base. In preferred embodiments of the present invention, the area of the reflective surface of the first reflector base is larger than the area of the reflective surface of the second reflector base.

The basic structure of the lighting assembly of the present invention can be adapted advantageously to many different installations. For example, the light socket housing can be recessed within a ceiling, with the light socket facing downward from the ceiling. In this case, the first reflector base can be disposed on the surface of the ceiling, with the reflective surface of the first reflector base facing generally downward from the ceiling, and the second reflector base can be a pendant suspended from any of the first reflector base, the light source housing, and the ceiling, with the reflective surface of the second reflector base facing generally upward toward the ceiling. In this embodiment, the light socket housing can include a suspension lacing ring, and the lighting assembly can further include suspension lacing connected to the suspension lacing ring and the second reflector base.

Alternatively, the first reflector base can be recessed within the surface of the ceiling, with the reflective surface of the first reflector base facing generally downward from the ceiling. In this case, the second reflector base can be a pendant suspended from any of the first reflector base, the light source housing, and the ceiling, with the reflective surface of the second reflector base facing generally upward toward the ceiling. In this embodiment, the light socket housing can includes a suspension lacing ring, and the lighting assembly can further include suspension lacing connected to the suspension lacing ring and the second reflector base.

In an alternative embodiment, the lighting assembly of the present invention can be used in an arena environment, such that the light socket housing is suspended from a ceiling structure, with the light socket facing downward from the ceiling structure. In this case, the first reflector base is also suspended from the ceiling structure, with the reflective surface of the first reflector base facing generally downward from the ceiling structure. Either or both of the light socket housing and the first reflector base can be suspended from the ceiling directly, or indirectly through the other component. As in the previously-described embodiments, the second reflector base can be a pendant suspended from any of the first reflector base, the light source housing, and the ceiling structure, with the reflective surface of the second reflector base facing generally upward toward the ceiling structure. In this case, the light socket housing can include a suspension lacing ring, and the lighting assembly can further include suspension lacing connected to the suspension lacing ring and the second reflector base.

According to another embodiment of the present invention, the first reflector base can be recessed within a desktop, with the reflective surface of the first reflector base facing generally upward from the desktop. In this embodiment, the second reflector base can be held above the first reflector base by spacers connected to at least one of the first reflector base, the light source housing, and the desktop, with the reflective surface of the second reflector base facing generally downward toward the first reflector base.

According to still another embodiment of the present invention, the first reflector base can be mounted atop a stand, such as a lamp stand with the reflective surface of the first reflector base facing generally upward from the stand. In this embodiment, the second reflector base can be held above the first reflector base by spacers connected to at least one of the first reflector base, the light source housing, and the stand, with the reflective surface of the second reflector base facing generally downward toward the first reflector base.

In any of these embodiments, the light socket can be of the type that is adapted to secure and provide electrical power to a light source, such as an incandescent light bulb, a halogen light bulb, a compact fluorescent bulb, an HID, and an LED. Further, to effectuated a desired lighting effect, the shape of the first reflector base, the second reflector base, or their respective reflective surfaces can be any shape, such as round, elliptical, ovular, or irregular.

DETAILED DESCRIPTION OF THE INVENTION

Figure 1:
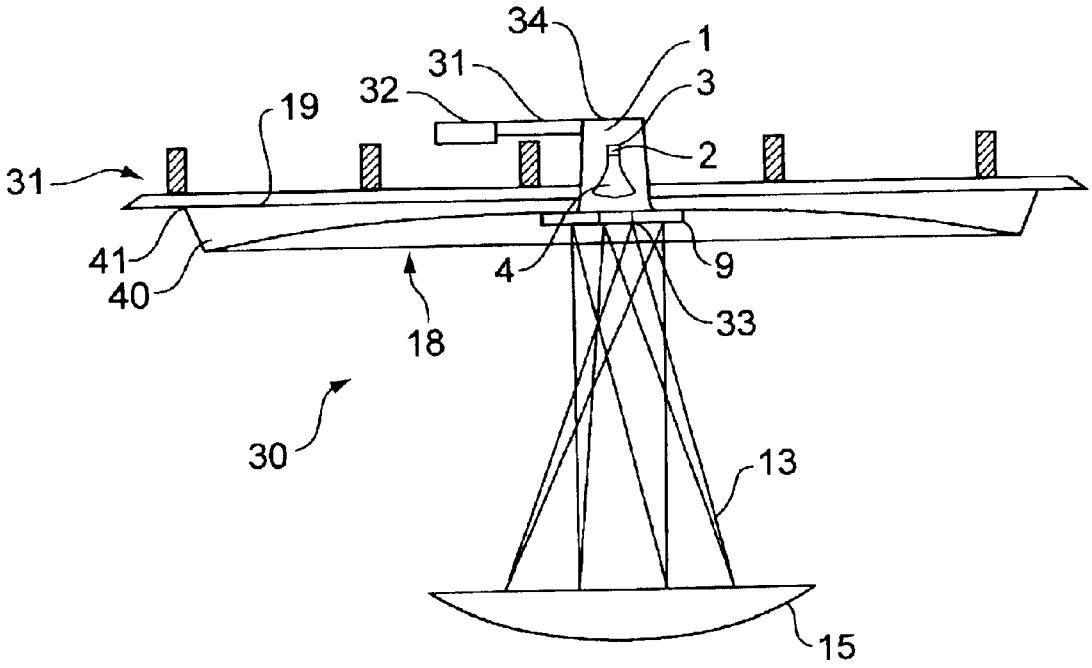
FIG. 1 shows an elevation view of the light fixture, including the recessed light source, pendant reflector, suspension lacing, and reflection cove.

Referring to FIG. 1, a lighting apparatus 30 according to the present invention includes a luminaire 1 that is contained within a luminaire housing 2. The luminaire housing 2 is fitted to a ceiling 31 such that it is recessed within the ceiling 31. The luminaire housing 2 is attached to the ceiling 31 using common construction techniques, and power is provided to the luminaire 1 by conventional means, such as a direct connection by wiring 43 to a junction box 32 or other power source. A standard-type light socket 3 is fitted to the interior base of the luminaire housing 2 such that the bulb 4 portion of the luminaire 1 is directed toward the open end 33 of the luminaire housing 2, that is, downward from the ceiling 31. It is contemplated that the luminaire housing 2 of the present invention can accommodate any type of residential or commercial light socket or connection, such as a receptacle for a halogen bulb or compact fluorescent lamp, or wires and clips for two-terminal style suspended lighting elements.

The base of the luminaire 1 is in communication with the light socket 3 and is secured by a conventional means, such as by screwing or snapping the light socket 3 into the base of the luminaire 1, and by providing appropriate electrical communication between the wiring 43 and the light socket 3 by, for example, solder joint or crimping connection. The luminaire housing 2 can be positioned in any type of ceiling, including a joist-type ceiling or a suspended ceiling, using common construction techniques. Also, it can be positioned in an arena environment, suspended from the roof where it appears to be recessed in an imaginary ceiling. In the exemplary embodiment shown in FIG. 1, the edge of the open end 33 of the luminaire housing 2 is approximately flush with the surrounding surface. It is contemplated that in other embodiments, the luminaire housing 2 can extend from the ceiling, either by attachment to the ceiling at the closed end 34 of the luminaire housing 2, or by cabling or other hanging attachments in an arena, warehouse, or other environment having an open ceiling. In certain embodiments, a portion of the side of the luminaire housing 2 proximate to the open end 33 of the luminaire housing 2 can be joined to the vertically situated mating surface of the recess existing in the interior ceiling 31 of a room. Likewise, a portion of the side of the luminaire housing 2 proximate to the open end 33 of the luminaire housing 2 can be joined to the vertically situated mating surface of the light fixture access hole existing in either a reflection cove 6 (FIG. 1) or a reflection dome 7 (FIG. 2), again using standard construction techniques.

Figure 3:
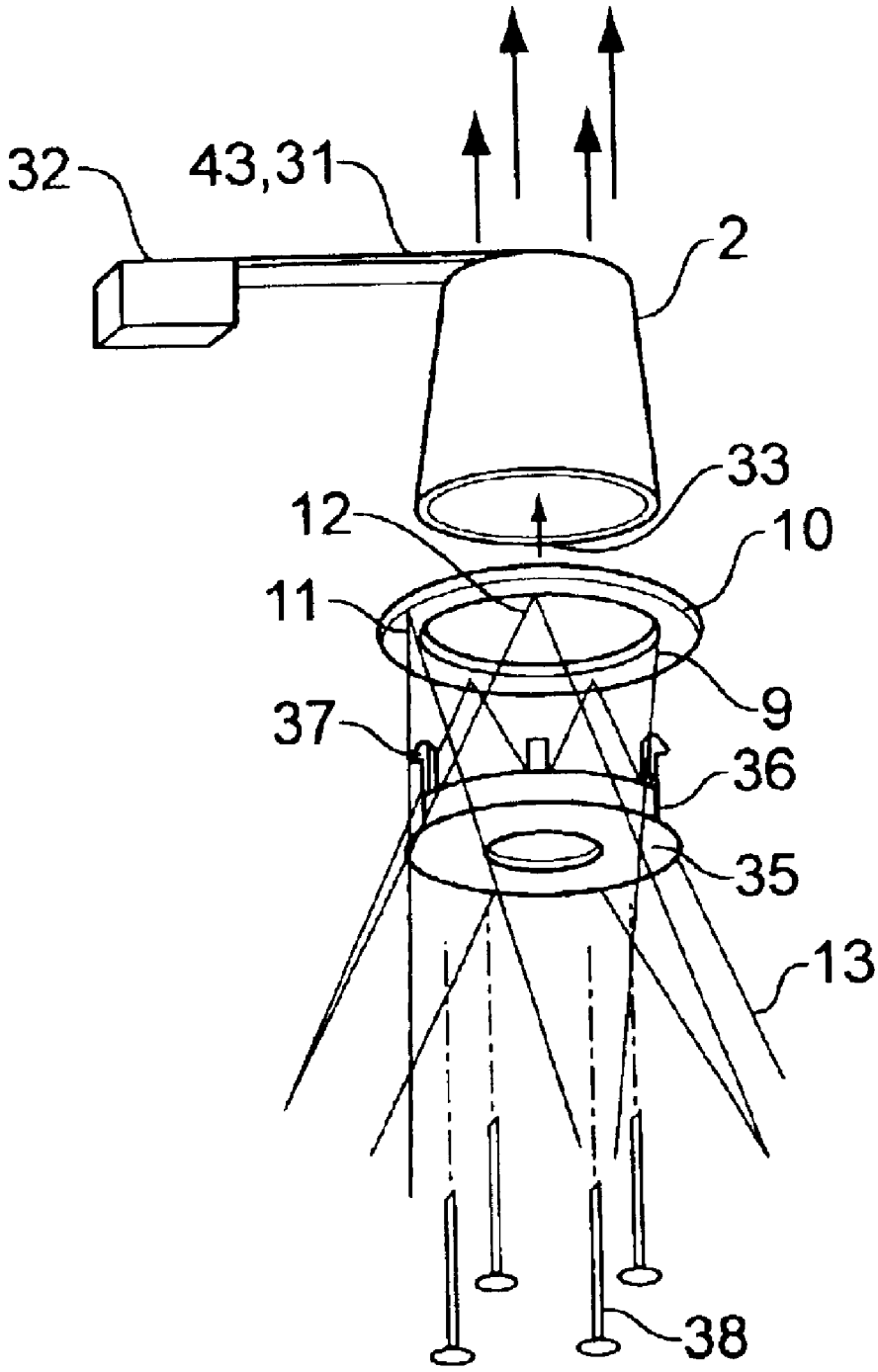
FIG. 3 shows a detailed exploded perspective view of the recessed luminaire housing, suspension lacing ring, and aperture plate.

With reference to FIG. 3, in an exemplary embodiment, the upper horizontal surface 10 of a suspension lacing ring 9 is in communication with the open end 33 edge surface of the luminaire housing 2. In an exemplary embodiment, the upper horizontal surface 10 of a suspension lacing ring 9 is joined to the open edge surface of the luminaire housing 2, using known construction techniques, such as through the use of commercially available construction adhesive (such as glue, joint compound, or epoxy), friction fit mating surfaces, spot welding, or fasteners.

In another exemplary embodiment, the open space of the suspension lacing ring 9 has a larger diameter than that of the luminaire housing 2. In this embodiment, there is no communication between the suspension lacing ring 9 and the luminaire housing 2. Instead, the upper horizontal surface 10 of the suspension lacing ring 9 is in sole communication with the lower surface of the reflection cove 6, the lower surface of the reflection dome 7, or the surface of the ceiling 31, depending on the application selected.

As shown in FIG. 3, in one exemplary embodiment, the suspension lacing ring 9 is removably attached to the luminaire housing 2 by an aperture plate 35, which includes a lower annular ridge 36 to support the suspension lacing ring 9, and can be snap-fit or otherwise attached to the luminaire housing 2 by, for example, flanges 37. The aperture plate 35 includes an aperture through which light from the luminaire 1 can pass. The suspension lacing ring 9 can be attached to the ceiling by a set of screws 38 or other fasteners, which can be affixed to a stem 31 connecting the wirebox of the recessed housing to the associated lamp housing in the ceiling through, for example, the suspension lacing ring 9.

Figure 4:
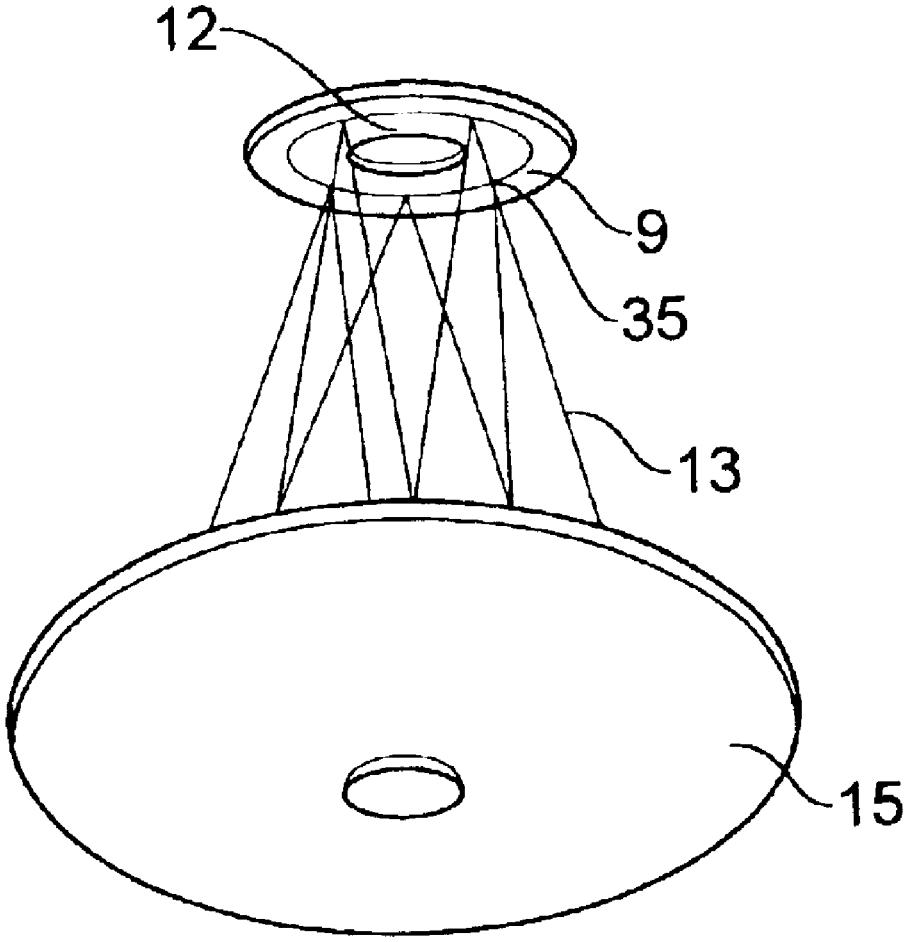
FIG. 4 shows a perspective view of the suspension lacing ring, suspension lacing, and pendant reflector.

The lower horizontal surface 11 of the suspension lacing ring 9 is fitted with a series of suspension eyelets 12, hooks, or other open guide construction, secured to the suspension lacing ring 9. In an exemplary embodiment, the suspension lacing ring 9 is made of molded plastic or metal, in which the suspension eyelets 12 are integrated as part of the suspension lacing ring mold. In other embodiments, the suspension eyelets 12 are distinct pieces of hardware secured to the lower horizontal surface 11 of the suspension lacing ring 9 using threads, friction, adhesion, or welding. The suspension eyelets 12 are utilized to secure suspension lacing 13, which in turn holds a pendant reflector 15 suspended below the luminaire housing 2, as shown in FIG. 4. This pendant reflector 15 has an upper concave surface generally opposite the suspension lacing ring 9.

Likewise, the upper concave surface 14 of the pendant reflector 15 is fitted with a series of pendant eyelets 16, hooks, or other open guide construction, secured to the pendant reflector 15. In an exemplary embodiment, the pendant reflector 15 is made of molded plastic or metal, in which the pendant eyelets 16 are integrated as part of the pendant reflector mold. In other exemplary embodiments, the pendant reflector 15 is fabricated of plastic, metal, or glass, and the pendant eyelets 16 are distinct pieces of hardware secured to the upper concave surface 14 of the pendant reflector 15 using, for example, threads, friction, adhesion, or welding.

Figure 5:
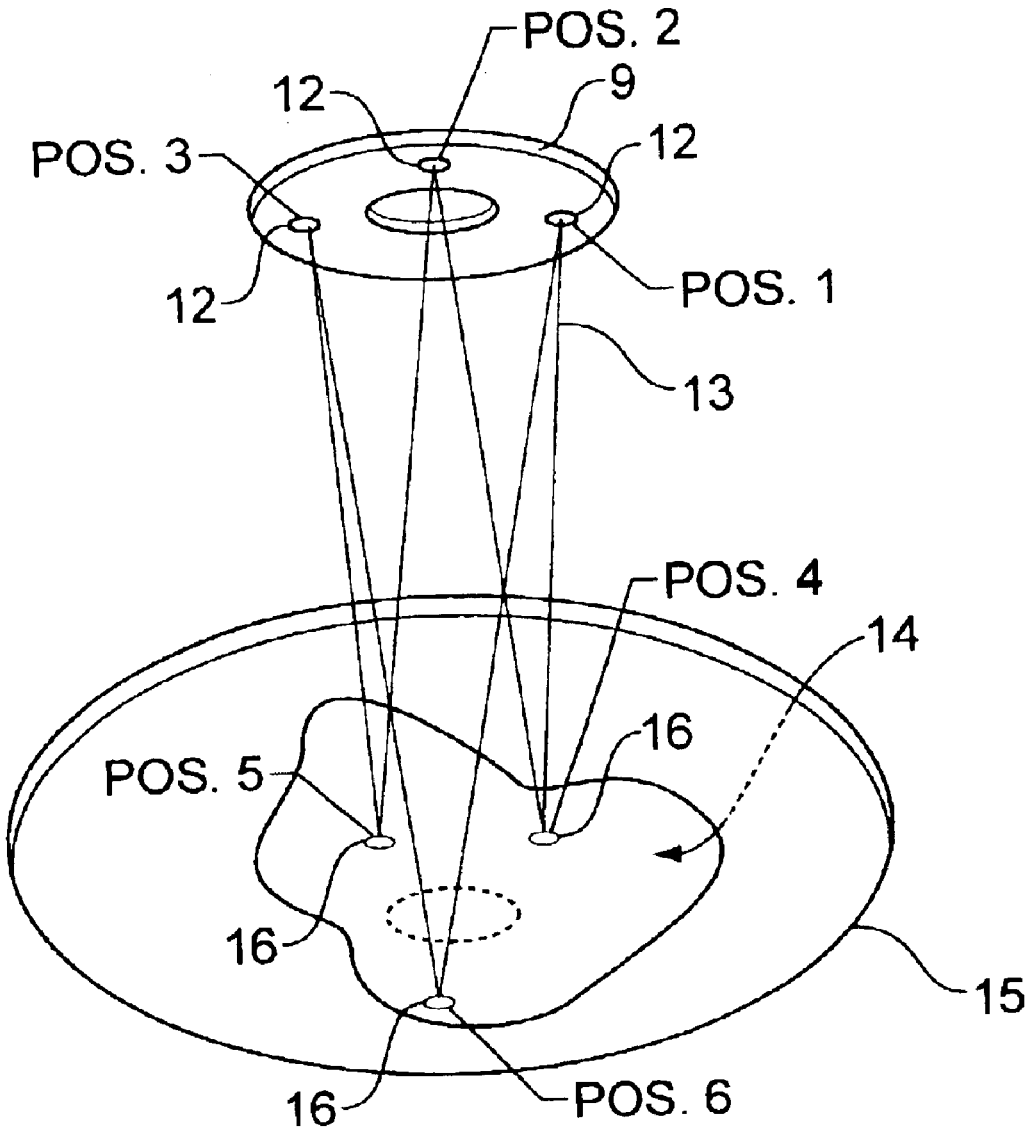
FIG. 5 shows a perspective view of the suspension lacing using three eyelets each at the suspension lacing ring and at the pendant reflector, with pendant reflector cut-away detail.
Figure 6:
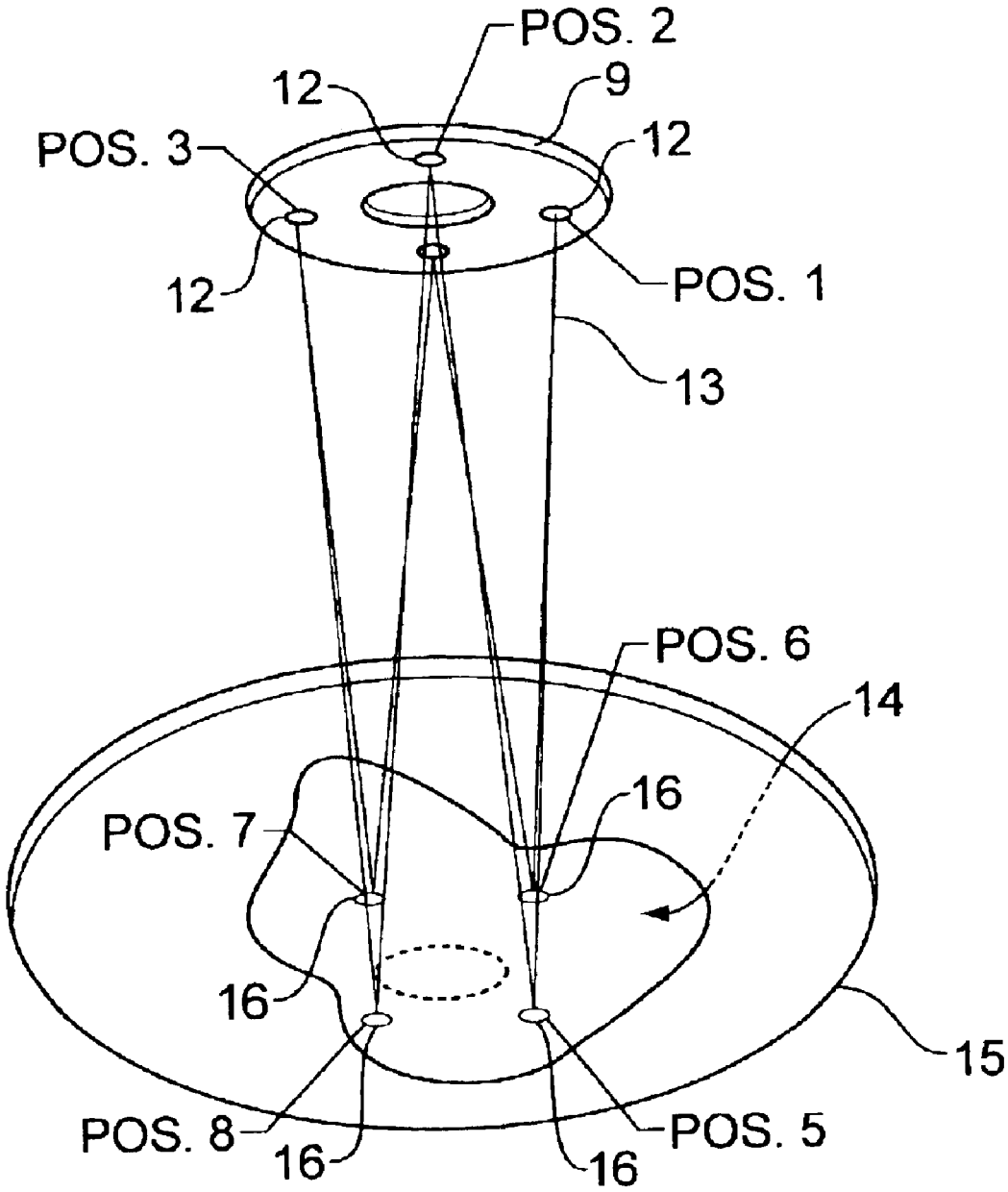
FIG. 6 shows a perspective view of the suspension lacing using four eyelets each at the suspension lacing ring and at the pendant reflector, with pendant reflector cut-away detail.
Figure 7:
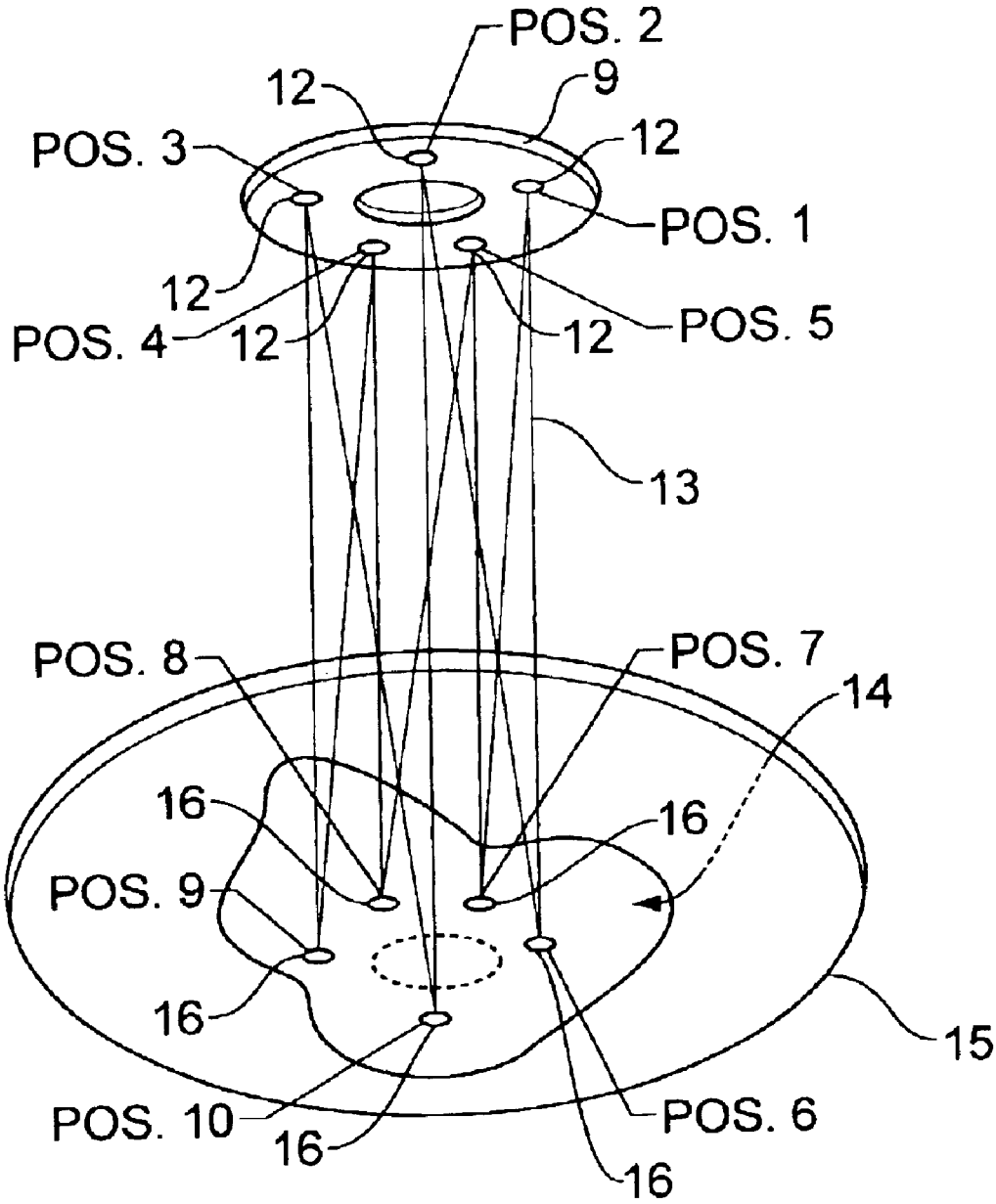
FIG. 7 shows a perspective view of the suspension lacing using five eyelets each at the suspension lacing ring and at the pendant reflector, with pendant reflector cut-away detail.

The number of suspension eyelets 12 utilized by the apparatus of the present invention is a consideration based on the ornamental design of the lighting apparatus 30, as well as on structural factors such as the dimensions and weight of the pendant reflector 15. For example, in an exemplary embodiment shown in FIG. 5, three suspension eyelets 12 are fitted to the lower horizontal surface 11 of the suspension lacing ring 9. In another exemplary embodiment, as shown in FIG. 6, four suspension eyelets 12 are fitted to the lower horizontal surface 11 of the suspension lacing ring 9. In yet another exemplary embodiment, as shown in FIG. 7, five suspension eyelets 12 are fitted to the lower horizontal surface 11 of the suspension lacing ring 9. Regardless of the number of eyelets fitted to the lower horizontal surface 11 of the suspension lacing ring 9, each suspension eyelet 12 is positioned so as to provide the desired look and structural integrity. For example, the suspension eyelets 12 can be disposed at equal distances from each adjacent suspension eyelet 12, in a regular but non-equidistant arrangement, or in an asymmetrical pattern. Each suspension eyelet 12 has an open space, or other opening that allows the suspension lacing 13 to be threaded through each suspension eyelet 12, or through any number of provided suspension eyelets 12 that are desired. Preferably, the open space of each suspension eyelet 12 is formed to allow the suspension lacing 13 to pass freely through the open space of each suspension eyelet 12 without snagging, although a grasping or fixing construction can be utilized in order to hold the suspension lacing 13 in place.

Likewise, the number of pendant eyelets 16 utilized by the present invention is a consideration based on the ornamental design of the light, as well as on structural factors such as the dimensions and weight of the pendant reflector 15. For example, in an exemplary embodiment shown in FIG. 5, three pendant eyelets 16 are fitted to the upper concave surface 14 of the pendant reflector 15. In another exemplary embodiment, as shown in FIG. 6, four pendant eyelets 16 are fitted to the upper concave surface 14 of the pendant reflector 15. In yet another exemplary embodiment, as shown in FIG. 7, five pendant eyelets 16 are fitted to the upper concave surface 14 of the pendant reflector 15. Regardless of the number of pendant eyelets 16 fitted to the upper concave surface 14 of the pendant reflector 15, the pendant eyelets 16 are arranged so as to provide the desired look and structural integrity, such as at equal distances from each adjacent pendant eyelet 16, in, for example, a circular pattern, in a regular but non-equidistant arrangement, or in an asymmetrical pattern.

In any embodiment, the number of pendant eyelets 16 fitted to the upper concave surface 14 of the pendant reflector 15 can be equal to the number of suspension eyelets 12 fitted to the lower horizontal surface 11 of the suspension lacing ring 9. Alternatively, the number of suspension eyelets 12 can be different than the number of pendant eyelets 16, in order to provide flexibility in arranging the pendant reflector 15. Each pendant eyelet 16 has an open space or other opening, which allows the suspension lacing 13 to be threaded through each pendant eyelet 16, or through any number of provided pendant eyelets 16 that are desired. Preferably, the open space of each pendant eyelet 16 is manufactured to allow the suspension lacing 13 to pass freely through the open space of each pendant eyelet 16 without snagging, although a grasping or fixing construction can be utilized in order to hold the suspension lacing 13 in place.

In alternative embodiments, some or all of the suspension eyelets 12 can be attached to the ceiling 31, or to a reflection cove 6 (described below) or reflection dome 7 (also described below). These embodiments provide alternative or additional support for the pendant reflector 15, alternative ornamentation for the lighting apparatus 30, and potential differences in effect on the resulting diffused light.

The pendant reflector 15 is fabricated in the shape of a concave bowl 17, such that the concave surface is directed at least generally toward the light source, so as to be able to reflect a least a portion of the light directed toward the pendant reflector 15 by the light source. The shape of the periphery of the concave bowl 17, as well as the degree of concavity, is determined by the light-diffusing qualities desired for the assembly. For example, according to an exemplary embodiment, the shape of the concave bowl 17 can be spherical, and the degree of concavity of the concave bowl 17 can be defined in all directions about its center point by the arc of a circle having a predetermined diameter, such as ten feet, or twenty feet, or any desired dimension, preferably having a diameter of between about 18 inches and about 96 inches. Alternatively, the peripheral shape of the concave bowl 17 can be elliptical, or any other desired shape, and the pendant reflector 15 itself can be flat, or convex. The pendant reflector 15 can be fabricated from any of a variety of materials, including production glass, limited edition art glass, spun metal, marquetry or other arrangement of wood, leather, fabric appliqué on a sturdy foundation, porcelain, or plastic. In addition, painted finishes can be applied to the pendant reflector 15, both on the outside to provide a desired ornamental look, and on the inside, to provide desired reflective features.

The suspension lacing 13 is fabricated from any of a variety of materials, including metal cable, cord, or monofilament, as well as various textile, synthetic, or composite materials. Although the suspension lacing 13 can be composed of several discrete lengths of material, it preferably is constructed as a continuous loop and threaded in a variety of ways through the suspension eyelets 12 and the pendant eyelets 16. In an exemplary embodiment, as shown in FIG. 5, the suspension lacing 13 is threaded sequentially through the suspension eyelets 12 and the pendant eyelets 16 at positions POS1, POS4, POS2, POS5, POS3, and POS6. In another exemplary embodiment, as shown in FIG. 6, the suspension lacing 13 is threaded sequentially through the suspension eyelets 12 and the pendant eyelets 16 at positions POS1, POS5, POS2, POS6, POS3, POS7, POS4, and POS8. In yet another exemplary embodiment, as shown in FIG. 7, the suspension lacing 13 is threaded sequentially through the suspension eyelets 12 and the pendant eyelets 16 at positions POS1, POS6, POS2, POS7, POS3, POS8, POS4, POS9, POS5, and POS10. It is contemplated that any quantity and arrangement of the suspension eyelets 12 and the pendant eyelets 16 can be used, including embodiments in which the number of suspension eyelets 12 is different than the number of pendant eyelets 16, in which the suspension lacing 13 is threaded more than once through one or more of the suspension eyelets 12 or the pendant eyelets 16, and in which some of the suspension eyelets 12 or the pendant eyelets 16 do not have the suspension lacing 13 threaded through them at all. The length of the suspension lacing 13 is also variable, depending on the number of threaded eyelets, the desired arrangement of the suspension lacing 13, and the distance required between the lower horizontal surface 11 of the suspension lacing ring 9 and the pendant reflector 15 for proper reflection and diffusion of light. For example, for the embodiment shown in FIG. 5, if the overall length of the suspension lacing 13 is between approximately five feet and eight feet, the vertical distance between the suspension lacing ring 9 and the pendant reflector 15 would be between approximately ten inches and 16 inches. For the embodiment shown in FIG. 6, if the overall length of the suspension lacing 13 is between approximately seven feet and 11 feet, the vertical distance between the suspension lacing ring 9 and the pendant reflector 15 would be between approximately 11 inches and 16 inches. For the embodiment shown in FIG. 7, if the overall length of the suspension lacing 13 is between approximately nine feet and 13 feet, the vertical distance between the suspension lacing ring 9 and the pendant reflector 15 would be between approximately 11 inches and 16 inches.

In each exemplary embodiment, and in those not shown, the distance between the suspension lacing ring 9 and the pendant reflector 15 can be adjusted by shortening the suspension lacing 13, or by replacing the suspension lacing 13 with a longer piece. It is contemplated that the present invention can be embodied such that the suspension lacing 13 is not formed as a continuous loop, but rather as a length of material that can be threaded between fixed points to an extent that provides the desired distance between the suspension lacing ring 9 and the pendant reflector 15. In addition, while the suspension lacing 13 is threaded between the suspension eyelets 12 and the pendant eyelets 16, the orientation of the pendent reflector 15 can be changed by lifting the pendent reflector 15 and adjusting the suspension lacing 13. In this manner, the release and application of tension on the suspension lacing 13 by hand makes it possible to orient the top plane of the pendant reflector 15 in an substantially horizontal position. If a grasping or otherwise prehensile construction is used for the suspension eyelets 12 or the pendant eyelets 16, the pendant reflector 15 can be adjusted such that it is not oriented in a substantially horizontal position, or can be adjusted to adapt to a sloped ceiling such that the pendant reflector 15 is oriented in a substantially horizontal position. Alternatively, the suspension lacing 13 can be replaced with rigid rods, spokes, or chains, or other suitable spacers attached to the pendant reflector 15 and any combination of the upper support structures.

In other exemplary embodiments, the upper horizontal surface 10 of the suspension lacing ring 9 is in communication with the lower surface of a reflection cove 6, as shown in FIG. 1. As shown, the reflection cove 6 is positioned toward the front end of the luminaire housing 2, and includes an aperture 39 through which light from within the luminaire housing 2 can pass. The suspension lacing ring 9 is preferably disposed so that the open space of the suspension lacing ring 9 and the aperture 39 of the reflection cove 6 are positioned to allow the maximum amount of light to pass from the luminaire housing 2 to the pendent reflector 15 without obstruction. The upper horizontal surface 10 of the suspension lacing ring 9 is joined to the lower surface of the reflection cove 6 by conventional construction techniques, such as through the use of a construction glue, joint compound, epoxy, or other common adhesive, or with fasteners, such as nails, tacks, screws, or rivets.

The reflection cove 6 is fabricated such that the lower surface of the reflection cove 6 is curved in the shape of a concave bowl 18, with the concavity directed generally toward the pendant reflector 15. The lower surface can have any curved shape, such as spherical, elliptical, or tubular section, dictated by the geometry of the rest of the light apparatus, and by the desired diffusion pattern of the resultant light. Alternative embodiments of the reflection cove 6 can also have surfaces that arc flat, or convex. The lower surface of the reflection cove 6 of the exemplary embodiment shown in FIG. 1 is defined by the arc of a circle. Similar embodiments can have different degrees of curvature, depending on the desired reflection pattern. For example, a reflection cove 6 shaped as a spherical section can have a degree of curvature defined by a sphere having a of any appropriate dimension, such as a diameter in a range of between four feet to about 12 feet. The reflection cove 6 can bc fabricated from any of a variety of materials, including production glass, limited edition art glass, spun metal, marquetry or other wood surfaces, leather, fabric appliqué on a sturdy material base, porcelain, plastic, or a casting of fiber reinforced plaster composite. In addition, painted finishes can be applied to the reflection cove 6, either for ornamental effect or reflective quality. In an exemplary embodiment, the base 19 of the reflection cove 6 is affixed to the surface of an interior ceiling by conventional construction techniques, such as through the use of a construction glue, joint compound, epoxy, or other common adhesive, or with fasteners, such as nails, tacks, screws, or rivets.

The edge of the aperture 39 of the reflection cove 6 is in communication with a portion of the side of the luminaire housing 2 proximate to the open end of the luminaire housing 2. In an exemplary embodiment, the edge of the aperture of the reflection cove 6 is joined with a portion of the side of the luminaire housing 2 proximate to the open end of the recessed luminaire housing 2. In an exemplary embodiment, the lower peripheral edge 40 of the reflection cove 6 is circular in shape, with a diameter that is suitable for the overall geometry of the apparatus, for example, between 36 inches and 72 inches, with a thickness of 4" to 12" for flat backed coves. Also in an exemplary embodiment, the base periphery 41 of the reflection cove 6 is circular in shape, with a diameter that is suitable for the overall geometry of the apparatus, for example, between about two feet and about six feet. In other exemplary embodiments, the lower peripheral edge 40 and base periphery 41 of the reflection cove 6 are not circular. Either or both can be some other rounded, polygonal, or mixed shape.

Figure 2:
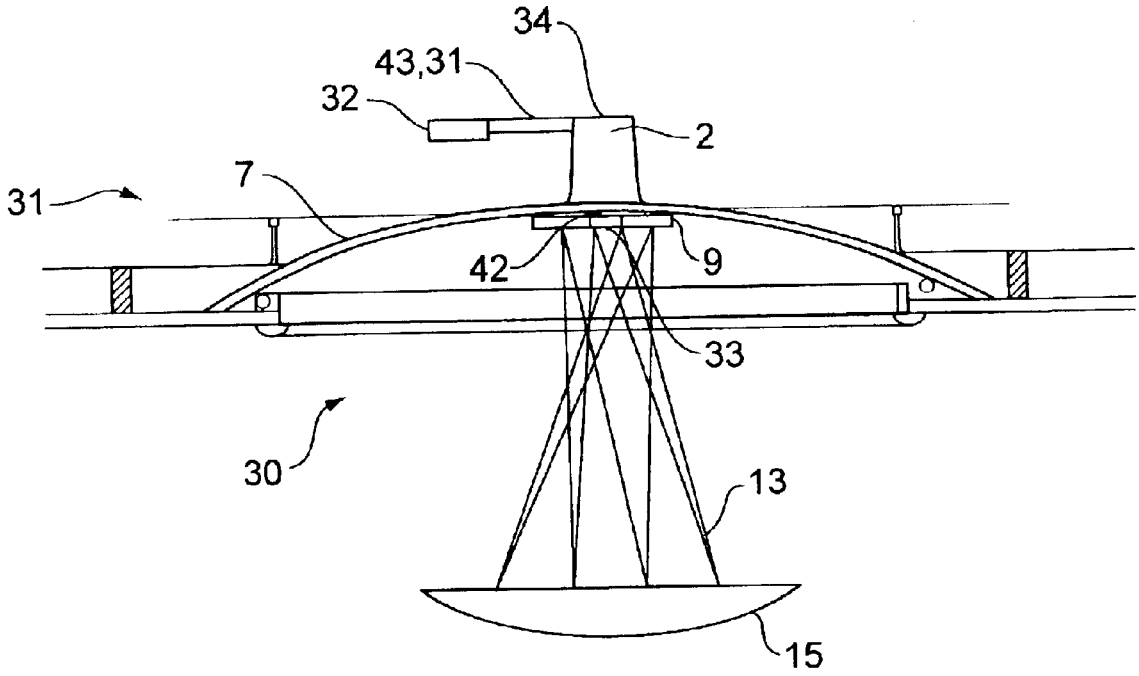
FIG. 2 shows an elevation view of the light fixture, including the recessed luminaire housing, pendant reflector, suspension lacing, and reflection dome.

In another exemplary embodiment, the upper horizontal surface 10 of the suspension lacing ring 9 is in communication with the lower surface of a reflection dome 7, as shown in FIG. 2. As shown, the reflection dome 7 is recessed in the ceiling, and is positioned toward the front end of the luminaire housing 2, and includes an aperture 42 through which light from within the luminaire housing 2 can pass. The suspension lacing ring 9 is preferably disposed so that the open space of the suspension lacing ring 9 and 20 the aperture 42 of the reflection dome 7 are positioned to allow the maximum amount of light to pass from the luminaire housing 2 to the pendent reflector 15 without obstruction. The upper horizontal surface 10 of the suspension lacing ring 9 is joined to the lower surface of the reflection dome 7 by conventional construction techniques, such as through the use of a construction glue, joint compound, epoxy, or other adhesive, or with fasteners such as nails, tacks, screws, or rivets.

The reflection dome 7 is fabricated such that the lower surface of the reflection dome 7 is formed in the shape of a concave bowl 20, with the concavity directed generally toward the pendant reflector 15. The lower surface can have any curved shape, such as spherical, elliptical, or tubular section, dictated by the geometry of the rest of the light apparatus, and by the desired diffusion pattern of the resultant light. Alternative embodiments of the reflection dome 7 can also have surfaces that are flat, or convex. The lower surface of the reflection dome 7 of the exemplary embodiment shown in FIG. 2 is defined by the arc of a circle. Similar embodiments can have different degrees of curvature, depending on the desired reflection pattern. For example, a reflection dome 7 shaped as a spherical section can have a degree of curvature defined by a sphere having a diameter of between about two and six feet, or any appropriate dimension. The reflection dome 7 can be fabricated from any of a variety of materials, including production glass, limited edition art glass, spun metal, marquetry or other wood surfaces, leather, fabric appliqué on a sturdy material base, porcelain, or plastic. In addition, painted finishes can be applied to the reflection dome 7, either for ornamental effect or reflective quality. In the exemplary embodiment shown in FIG. 2, the reflection dome 7 is recessed entirely within an opening in the surface of an interior ceiling. The reflection dome 7 is secured to ceiling support structures in a manner consistent with standard home construction techniques. The edge of the upper aperture of the reflection dome 7 is in communication with a portion of the side of the luminaire housing 2 proximate to the open end of the luminaire housing 2. In an exemplary embodiment, the edge of the upper aperture of the reflection dome 7 is joined with a portion of the side of the luminaire housing 2 proximate to the open end of the luminaire housing 2. In an exemplary embodiment, the outer peripheral edge of the reflection dome 7 is circular in shape, with a diameter that is suitable for the overall geometry of the apparatus, for example, between one and two feet. In other exemplary embodiments, the outer peripheral edge of the reflection dome 6 are not circular, and can be some other rounded, polygonal, or mixed shape.

Preferred and alternative embodiments of the present invention have been described in detail. The particular described embodiments are not limiting of the present invention. Rather, the described embodiments are illustrative of the inventive concept, which is recited in the claims. The claims, therefore, should be given the broadest interpretation possible, limited only by the known prior art, and not by any exemplary structural details set forth in the written description. Various structural details of the present invention as described may be modified within the spirit and scope of the present invention as contemplated by the inventor.

For example, the lighting apparatus of the present invention need not be suspended from a ceiling, and instead can be embodied as a floor lamp, desk lamp, or recessed lamp within a desktop (stated broadly to include a counter top or table top). For example, FIG. 8 shows the lighting apparatus of the present invention in an exemplary floor lamp 50 embodiment. The floor lamp 50 includes a weighted base 51, a stand 52, and a light source 59, such as a luminaire within a housing 53. The luminaire housing 53 is supported by the stand 52, which may be a rigid rod or somewhat flexible (bendable) support that allows the light source 59 to be directed to a certain degree. The weighted base 51 has a proper combination of footprint surface area and mass to ensure that the floor lamp 50 remains upright while the weighted base 51 rests on the floor. The luminaire housing 53 is oriented such that the light emanating from the light source 59 is aimed in a generally upward direction.

A primary reflector 54 is positioned generally opposite the luminaire housing 53, such that light emanating from the light source 59 is directed generally toward the primary reflector 54. The primary reflector 54 is made from a material that is sufficiently rigid so as to retain its shape, and that can withstand any heat generated by the light source 59. The primary reflector 54 has a generally concave shape, oriented such that the concavity is facing the luminaire housing 53. In an exemplary embodiment, the primary reflector 54 is fabricated from a material that is reflective of light at least to a degree necessary to provide necessary lighting for the desired area proximate to the floor lamp 50. In another exemplary embodiment, the concave surface of the primary reflector 54 is coated with a material that is reflective of light at least to a degree necessary to provide necessary lighting for the desired area proximate to the floor lamp 50.

The floor lamp 50 also includes a secondary reflector 55, which is located behind the opening 56 in the luminaire housing 53, that is, behind the area from which light emanates from the luminaire housing 53. The secondary reflector 55 has a generally concave shape, oriented such that the concavity is facing the primary reflector 54. In an exemplary embodiment, the secondary reflector 55 is fabricated from a material that is reflective of light at least to a degree necessary to provide necessary lighting for the desired area proximate to the floor lamp 50. In another exemplary embodiment, the concave surface of the secondary reflector 55 is coated with a material that is reflective of light at least to a degree necessary to provide necessary lighting for the desired area proximate to the floor lamp 50. The secondary reflector 55 has an aperture 57 through which the opening 56 of the luminaire housing 53 is directed, and by which the secondary reflector 55 is attached to the luminaire housing 53. Light emanating from the luminaire housing 53 passes through the aperture 57, so that it can reach the primary reflector 54 with little or no obstruction.

The primary reflector 54 is connected to the luminaire housing 53 or the secondary reflector 55, or both, by extension rods 58 or other suitable spacers. The extension rods 58 are sufficiently rigid to hold the primary reflector 54 in place, but do not substantially block light reflected from the primary reflector 54 or the secondary reflector 55. Thus, the light emanating from the light source 59 within the luminaire housing 53 reflects off the primary reflector 54, the reflected light reflects off the secondary reflector 55, and the twice-reflected light illuminates the space in which the floor lamp 50 is located. Some percentage of the initial light from the light source 59 may directly illuminate the room by passing unreflected past the primary reflector 54, depending on the degree of focus of the light source 59 and the size of the primary reflector 54. Likewise, some percentage of the light reflected from the primary reflector 54 may directly illuminate the room by passing unreflected past the secondary reflector 55, depending on the degree of diffusion of the reflected light and the size of the secondary reflector 55. The number and arrangement of the extension rods 58 are determined by the material and dimensions of the extension rods 58, as these parameters affect the structural integrity of the floor lamp 50, the desired ornamental look of the floor lamp 50, and the desired partial blocking effect that the extension rods 58 have on the pattern of the light emanating from the floor lamp 50.

FIG. 9 shows the lighting apparatus of the present invention in an exemplary table or desk lamp 60 embodiment. The table lamp 60 includes a weighted base 61, a stand 62, and a light source 69, such as a luminaire within a housing 63. The luminaire housing 63 is supported by the stand 62, which may be a rigid rod or somewhat flexible (bendable) support that allows the light source 69 to be directed to a certain degree. The weighted base 61 has a proper combination of footprint surface area and mass to ensure that the table lamp 60 remains upright while the weighted base 61 rests on the table. The luminaire housing 63 is oriented such that the light emanating from the light source 69 is aimed in a generally upward direction.

A primary reflector 64 is positioned generally opposite the luminaire housing 63, such that light emanating from the light source 69 is directed generally toward the primary reflector 64. The primary reflector 64 is made from a material that is sufficiently rigid so as to retain its shape, and that can withstand any heat generated by the light source 69. The primary reflector 64 has a generally concave shape, oriented such that the concavity is facing the luminaire housing 63. In an exemplary embodiment, the primary reflector 64 is fabricated from a material that is reflective of light at least to a degree necessary to provide necessary lighting for the desired area proximate to the table lamp 60. In another exemplary embodiment, the concave surface of the primary reflector 64 is coated with a material that is reflective of light at least to a degree necessary to provide necessary lighting for the desired area proximate to the table lamp 60.

The table lamp 60 also includes a secondary reflector 65, which is located behind the opening 66 in the luminaire housing 63, that is, behind the area from which light emanates from the luminaire housing 63. The secondary reflector 65 has a generally concave shape, oriented such that the concavity is facing the primary reflector 64. In an exemplary embodiment, the secondary reflector 65 is fabricated from a material that is reflective, of light at least to a degree necessary to provide necessary lighting for the desired area proximate to the table lamp 60. In another exemplary embodiment, the concave surface of the secondary reflector 65 is coated with a material that is reflective of light at least to a degree necessary to provide necessary lighting for the desired area proximate to the table lamp 60. The secondary reflector 65 has an aperture 67 through which the opening 66 of the luminaire housing 63 is directed, and by which the secondary reflector 65 is attached to the luminaire housing 63. Light emanating from the luminaire housing 63 passes through the aperture 67, so that it can reach the primary reflector 64 with little or no obstruction.

The primary reflector 64 is connected to the luminaire housing 63 or the secondary reflector 65, or both, by extension rods 68 or other suitable spacers. The extension rods 68 are sufficiently rigid to hold the primary reflector 64 in place, but do not substantially block light reflected from the primary reflector 64 or the secondary reflector 65. Thus, the light emanating from the light source 69 within the luminaire housing 63 reflects off the primary reflector 64, the reflected light reflects off the secondary reflector 65, and the twice-reflected light illuminates the space in which the table lamp 60 is located. Some percentage of the initial light from the light source 69 may directly illuminate the room by passing unreflected past the primary reflector 64, depending on the degree of focus of the light source 69 and the size of the primary reflector 64. Likewise, some percentage of the light reflected from the primary reflector 64 may directly illuminate the room by passing unreflected past the secondary reflector 65, depending on the degree of diffusion of the reflected light and the size of the secondary reflector 65. The number and arrangement of the extension rods 68 are determined by the material and dimensions of the extension rods 68, as these parameters affect the structural integrity of the table lamp 60, the desired ornamental look of the table lamp 60, and the desired partial blocking effect that the extension rods 68 have on the pattern of the light emanating from the table lamp 60.

FIG. 10 shows the lighting apparatus of the present invention in an exemplary recessed lamp 70 embodiment, located in a recessed space 80 within a counter, desk, or similar piece of furniture 81. The recessed lamp 70 includes a base 71 supporting a light source 79, such as a luminaire within a housing 73. The luminaire housing 73 is oriented such that the light emanating from the light source 79 is aimed in a generally upward direction.

A primary reflector 74 is positioned generally opposite the luminaire housing 73, such that light emanating from the light source 79 is directed generally toward the primary reflector 74. The primary reflector 74 is made from a material that is sufficiently rigid so as to retain its shape, and that can withstand any heat generated by the light source 79. The primary reflector 74 has a generally concave shape, oriented such that the concavity is facing the luminaire housing 73. In an exemplary embodiment, the primary reflector 74 is fabricated from a material that is reflective of light at least to a degree necessary to provide necessary lighting for the desired area proximate to the recessed lamp 70. In another exemplary embodiment, the concave surface of the primary reflector 74 is coated with a material that is reflective of light at least to a degree necessary to provide necessary lighting for the desired area proximate to the recessed lamp 70.

The recessed lamp 70 also includes a secondary reflector 75, which is located behind the opening 76 in the luminaire housing 73, that is, behind the area from which light emanates from the luminaire housing 73. The secondary reflector 75 has a generally concave shape, oriented such that the concavity is facing the primary reflector 74. In an exemplary embodiment, the secondary reflector 75 is fabricated from a material that is reflective of light at least to a degree necessary to provide necessary lighting for the desired area proximate to the recessed lamp 70. In another exemplary embodiment, the concave surface of the secondary reflector 75 is coated with a material that is reflective of light at least to a degree necessary to provide necessary lighting for the desired area proximate to the recessed lamp 70. The secondary reflector 75 has an aperture 77 through which the opening 76 of the luminaire housing 73 is directed, and by which the secondary reflector 75 is attached to the luminaire housing 73. Light emanating from the luminaire housing 73 passes through the aperture 77, so that it can reach the primary reflector 74 with little or no obstruction. Alternatively, the secondary reflector 75 is formed integrally with the base 71, and the luminaire housing 73 is attached to the secondary reflector 75 at a back side 72 of the luminaire housing 73.

The primary reflector 74 is connected to the luminaire housing 73, the secondary reflector 75, the counter/desk 81, or any combination of the three, by extension rods 78 or other suitable spacers. The extension rods 78 are sufficiently rigid to hold the primary reflector 74 in place, but do not substantially block light reflected from the primary reflector 74 or the secondary reflector 75. Thus, the light emanating from the light source 79 within the luminaire housing 73 reflects off the primary reflector 74, the reflected light reflects off the secondary reflector 75, and the twice-reflected light illuminates the space around which the recessed lamp 70 is located. Some percentage of the initial light from the light source 79 may directly illuminate the room by passing unreflected past the primary reflector 74, depending on the degree of focus of the light source 79 and the size of the primary reflector 74. The number and arrangement of the extension rods 78 are determined by the material and dimensions of the extension rods 78, as these parameters affect the structural integrity of the recessed lamp 70, the desired ornamental look of the recessed lamp 70, and the desired partial blocking effect that the extension rods 78 have on the pattern of the light emanating from the recessed lamp 70.

I claim:

1. A lighting assembly, comprising:

a light socket, at least partially disposed in a housing;

a first reflector base, having an aperture through which the light socket is accessible, and a reflective surface generally facing away from the light socket, wherein the light socket is disposed behind the reflective surface; and a second reflector base, connected to at least one of the first reflector base and the light source housing, having a reflective surface generally facing the light source and the reflective surface of the first reflector base.

2. The lighting assembly of claim 1, wherein the first reflection base has a flat reflective surface adjacent the aperture, and a curved reflective surface at the periphery of the first reflection base, wherein the curved reflective surface curves generally toward the second reflector base.

3. The lighting assembly of claim 1, wherein the reflective surface of the first reflector base is concave, wherein the concavity is directed generally toward the second reflector base.

4. The lighting assembly of claim 1, wherein the reflective surface of the second reflector base is concave, wherein the concavity is directed generally toward the first reflector base.

5. The lighting assembly of claim 1, wherein the area of the reflective surface of the first reflector base is larger than the area of the reflective surface of the second reflector base.

6. The lighting assembly of claim 1, wherein:

the light socket housing is recessed within a ceiling, with the light socket facing downward from the ceiling;

the first reflector base is disposed on the surface of the ceiling, with the reflective surface of the first reflector base facing generally downward from the ceiling; and the second reflector base is a pendant suspended from at least one of the first reflector base, the light source housing, and the ceiling, with the reflective surface of the second reflector base facing generally upward toward the ceiling.

7. The lighting assembly of claim 6, wherein the light socket housing includes a suspension lacing ring, and the lighting assembly further includes suspension lacing connected to the suspension lacing ring and the second reflector base.

8. The lighting assembly of claim 1, wherein:

the first reflector base is recessed within the surface of the ceiling, with the reflective surface of the first reflector base facing generally downward from the ceiling; and the second reflector base is a pendant suspended from at least one of the first reflector base, the light source housing, and the ceiling, with the reflective surface of the second reflector base facing generally upward toward the ceiling.

9. The lighting assembly of claim 8, wherein the light socket housing includes a suspension lacing ring, and the lighting assembly further includes suspension lacing connected to the suspension lacing ring and the second reflector base.

10. The lighting assembly of claim 1, wherein:

the light socket housing is suspended from a ceiling structure, with the light socket facing downward from the ceiling structure;

the first reflector base is suspended from the ceiling structure, with the reflective surface of the first reflector base facing generally downward from the ceiling structure; and the second reflector base is a pendant suspended from at least one of the first reflector base, the light source housing, and the ceiling structure, with the reflective surface of the second reflector base facing generally upward toward the ceiling structure.

11. The lighting assembly of claim 10, wherein the light socket housing includes a suspension lacing ring, and the lighting assembly further includes suspension lacing connected to the suspension lacing ring and the second reflector base.

12. The lighting assembly of claim 1, wherein:

the first reflector base is recessed within a desktop, with the reflective surface of the first reflector base facing generally upward from the desktop; and the second reflector base is held above the first reflector base by spacers connected to at least one of the first reflector base, the light source housing, and the desktop, with the reflective surface of the second reflector base facing generally downward toward the first reflector base.

13. The lighting assembly of claim 1, wherein:

the first reflector base is mounted atop a stand, with the reflective surface of the first reflector base facing generally upward from the stand; and the second reflector base is held above the first reflector base by spacers connected to at least one of the first reflector base, the light source housing, and the stand, with the reflective surface of the second reflector base facing generally downward toward the first reflector base.

14. The lighting assembly of claim 13, wherein the stand is a lamp stand.

15. The lighting assembly of claim 1, wherein the light socket is adapted to secure and provide electrical power to a light source.

16. The lighting assembly of claim 15, wherein the light socket is adapted to secure and provide electrical power to at least one of an incandescent light bulb, a halogen light bulb, a compact fluorescent bulb, an HID, and an LED.

17. The lighting assembly of claim 1, wherein a peripheral shape of the first reflector base is round.

18. The lighting assembly of claim 1, wherein a peripheral shape of the second reflector base is round.

19. The lighting assembly of claim 1, wherein a peripheral shape of the reflective surface of the first reflector base is round.

20. The lighting assembly of claim 1, wherein a peripheral shape of the reflective surface of the second reflector base is round.

* * * * *